United States Patent [19]

Cook

[11] Patent Number: 5,069,188

[45] Date of Patent: Dec. 3, 1991

[54] REGULATED CANISTER PURGE SOLENOID VALVE HAVING IMPROVED PURGING AT ENGINE IDLE

[75] Inventor: John E. Cook, Chatham, Canada

[73] Assignee: Siemens Automotive Limited, Chatham, Canada

[21] Appl. No.: 656,930

[22] Filed: Feb. 15, 1991

[51] Int. Cl.[5] ..... F02M 33/02

[52] U.S. Cl. ..... 123/520; 123/516; 123/518; 137/599.1; 137/516.27

[58] Field of Search ..... 123/516, 518, 519, 520, 123/521, 458; 137/599, 599.1, 907, 516.27

[56] References Cited

U.S. PATENT DOCUMENTS

| | | | |
|---|---|---|---|
| 4,044,743 | 8/1977 | Eaton | 123/520 |
| 4,086,897 | 5/1978 | Tamura et al. | 123/520 |
| 4,153,025 | 5/1979 | Thornburgh | 123/520 |
| 4,308,841 | 1/1982 | Kingsley | 123/520 |
| 4,480,661 | 11/1984 | Kawai et al. | 137/599.1 |
| 4,530,329 | 7/1985 | Maisch et al. | 123/458 |
| 4,541,396 | 9/1985 | Sato et al. | 123/518 |
| 4,593,672 | 6/1986 | Barone | 123/518 |
| 4,628,887 | 12/1986 | Mitchell et al. | 123/520 |
| 4,681,297 | 7/1987 | Mertz | 137/599 |
| 4,703,737 | 11/1987 | Cook et al. | 123/518 |
| 4,809,667 | 3/1989 | Uranishi et al. | 123/520 |
| 4,901,702 | 2/1990 | Beicht et al. | 123/520 |
| 4,941,447 | 7/1990 | Mannhardt | 123/458 |
| 4,944,276 | 7/1990 | House et al. | 123/520 |
| 4,951,637 | 8/1990 | Cook | 123/519 |
| 4,953,514 | 9/1990 | Beicht et al. | 123/458 |

*Primary Examiner*—Willis R. Wolfe
*Assistant Examiner*—Tom Moulis
*Attorney, Agent, or Firm*—George L. Boller; Russel C. Wells

[57] ABSTRACT

Improved idle purging is obtained in a regulated canister purge solenoid valve by communicating the atmospheric chamber space of the regulator mechanism to atmosphere through the canister and providing in the movable wall of the regulator mechanism an orifice which is closed by abutment of a surrounding portion of the movable wall with an internal surface of the atmospheric chamber space when the engine is off, but is opened when that surrounding portion of the movable wall leaves that internal surface of the atmospheric chamber space upon engine running.

10 Claims, 1 Drawing Sheet

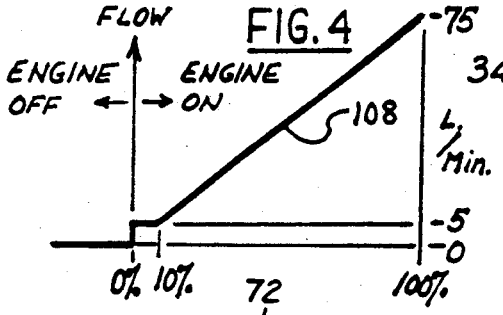
FIG. 4
FIG. 3
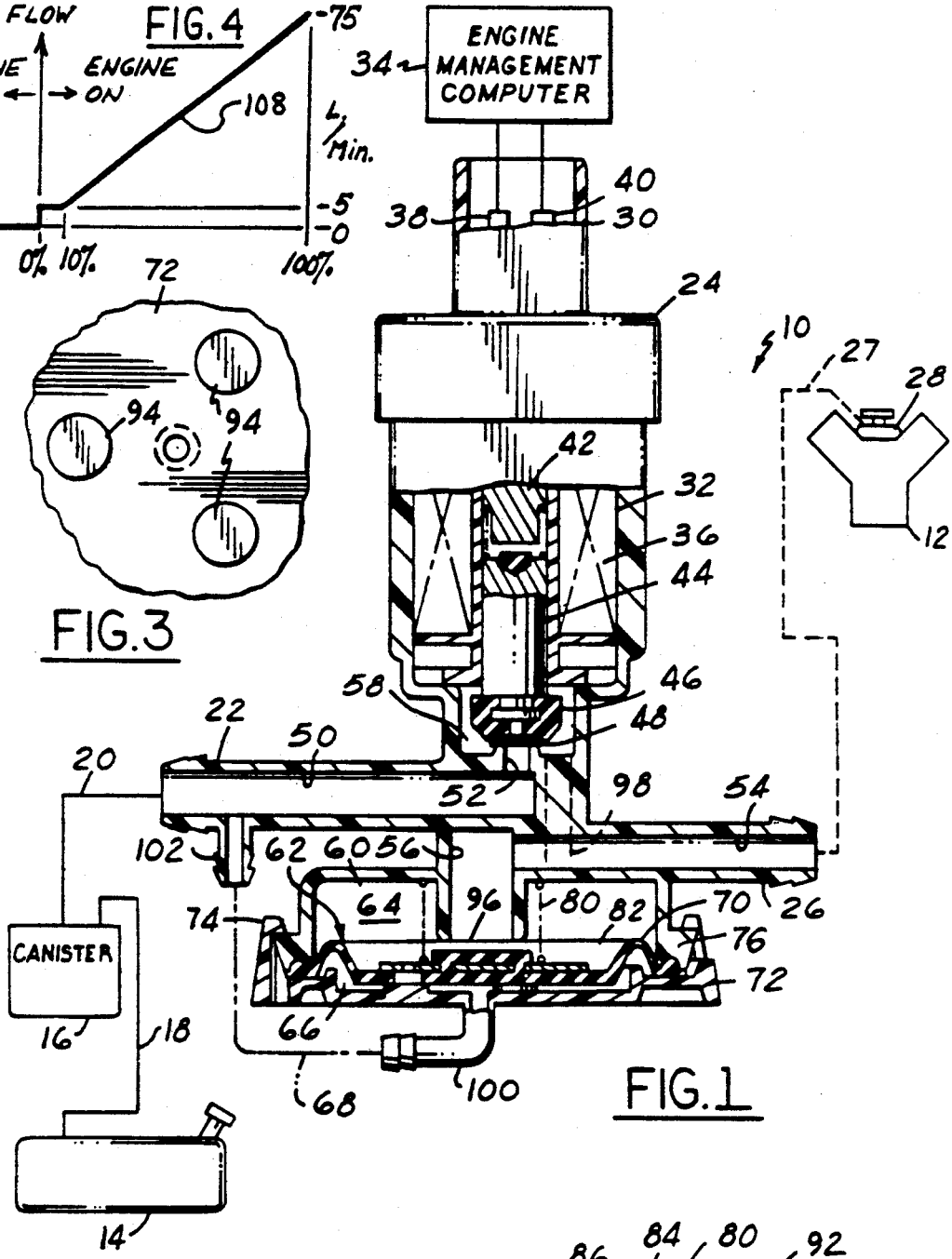
FIG. 1
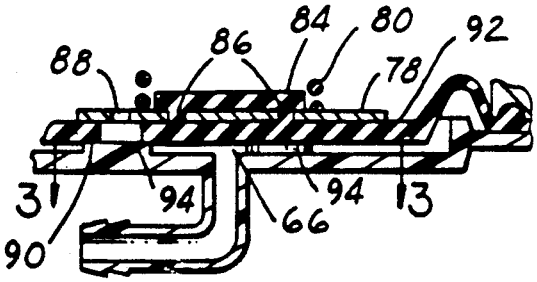
FIG. 2

REGULATED CANISTER PURGE SOLENOID VALVE HAVING IMPROVED PURGING AT ENGINE IDLE

FIELD OF THE INVENTION

This invention relates to a regulated canister purge solenoid valve that is used in an evaporative emission control system of an automotive vehicle internal combustion engine to control the purging of fuel vapors that have been collected in a canister to the engine intake manifold for entrainment with combustion flow into the combustion chamber space of the engine.

BACKGROUND AND SUMMARY OF THE INVENTION

A Purge Valve For On Board Fuel Vapor Recovery Systems is disclosed in U.S. Pat. No. 4,944,276. That purge valve comprises a solenoid-controlled valve and a regulator valve that are in series between the purge valve's inlet and outlet ports. The regulator valve makes the response of the purge valve to electrical signals acting upon the solenoid-controlled valve relatively insensitive to variations in the intensity of intake manifold vacuum at the outlet port over a certain range of magnitude of vacuum. Even when the purge valve includes this regulating function, difficulties are encountered in accomplishing controlled purging of the canister at engine idle when the manifold vacuum is high and the flow of combustible mixture into the engine cylinders is relatively low. The present invention is directed to a solution to this problem and provides a new and improved regulated canister purge solenoid valve which is capable of providing improved purge control at engine idle.

The improved purge valve of the present invention accomplishes this result without the necessity of major modifications to the previously known purge valve, and therefore provides a very significant functional benefit in a quite cost-effective manner. It is believed that the valve of the invention will be capable of assisting evaporative emission control systems of future automotive vehicles in attaining compliance with stricter government-promulgated evaporative emission standards.

Further features, advantages, and benefits of the invention will be seen in the ensuing description and claims which are accompanied by a drawing. The drawing discloses a presently preferred embodiment of the invention in accordance with the best mode contemplated at the present time in carrying out the invention.

BRIEF DESCRIPTION OF THE DRAWING

FIG. 1 is a longitudinal view, partly in cross section, through a regulated canister purge solenoid valve embodying principles of the invention, and includes a schematic representation of how the valve is disposed in an evaporative emission control system of an automotive vehicle that is powered by an internal combustion engine.

FIG. 2 is an enlarged fragmentary view of a lower portion of FIG. 1.

FIG. 3 is a fragmentary view in the direction of arrows 3—3 in FIG. 2.

FIG. 4 is a graph that is useful in appreciating the improvement that the valve provides.

DESCRIPTION OF THE PREFERRED EMBODIMENT

FIG. 1 shows an evaporative emission control system (EECS) 10 in association with an internal combustion engine 12 of an automotive vehicle and a fuel tank 14 of the vehicle that carries a supply of volatile liquid fuel for operating the engine to power the vehicle. EECS 10 comprises a conventional canister 16 that is connected via a conduit 18 to the headspace of tank 14 for collecting volatized fuel vapor from the tank. The tank is kept substantially at atmospheric pressure by a conventional vent valve (not shown) and/or canister 16 may contain a vent valve (also not shown). Canister 14 is in turn connected by a conduit 20 to an inlet port 22 of a regulated canister purge solenoid valve (RCPS valve) 24 embodying the inventive principles. An outlet port 26 of RCPS valve 24 is connected by a conduit 27 to an intake manifold 28 of engine 12. RCPS valve 24 also has an electrical connector 30 that electrically connects a solenoid 32 of RCPS valve 24 to a computer 34 that is associated with operation of engine 12, such as an engine management computer.

RCPS valve 24 comprises body structure that receives and securely retains solenoid 32. Solenoid 32 comprises a coil 36 having terminations at corresponding terminals 38, 40 of connector 30 so that signals from computer 34 can be applied to coil 36. The solenoid also has a stator 42 and a spring-biased armature 44. The end of armature 44 that is external to coil 36 contains a valve element 46 that is shown in FIG. 1 seated on an internal valve seat 48 within the body structure of RCPS valve 24. This represents the condition that exists when coil 36 is not energized from computer 34. When coil 36 is energized, armature 44 is retracted away from valve seat 48 causing valve element 46 to unseat from valve seat 48.

The body structure comprises: a radial passage 50 that extends from inlet port 22 to an intersection with one end of a short axial passage 52 which contains valve seat 48 at its opposite end; a radial passage 54 that extends from outlet port 26 to an intersection with one end of a short axial passage 56; a chamber 58 at the end of passage 52 opposite its intersection with passage 50; and a chamber 60 at the end of passage 56 opposite its intersection with passage 54. A movable wall 62 divides chamber 60 into a chamber space 64 to which axial passage 56 is open and a chamber space 66 that is communicated to inlet port 22 by a passage 68.

Movable wall 62 comprises a generally circular diaphragm 70 of suitable material whose outer peripheral margin in captured and sealed on the body structure in conventional manner, such as by the use of a cap 72 which has a snap-fit attachment 74 to a circular flange 76 that bounds the periphery of chamber space 64. An insert 78 that is generally circular and relatively more rigid than the material of diaphragm 70 is disposed centrally in movable wall 62. A helical coil spring 80 is disposed in chamber space 64 and acts between the body structure and insert 78 to resiliently bias movable wall 62 away from passage 56. When there are equal gas pressures on opposite sides of wall 62, the central region of the wall is forced against the inside of cap 72 by the spring bias force, and this condition is portrayed by FIGS. 1 and 2.

Movable wall 62 is preferably fabricated by insert-molding diaphragm 70 onto insert 78 in a mold cavity. The cavity is shaped to create an annular convolute 82 in the diaphragm and at the center of the diaphragm a circular sealing pad 84 which faces the end of passage 56. Insert 78 preferably contains several holes 86 that enable sealing pad 84 to integrally unite with diaphragm material on the opposite side of the insert during the molding process; this strengthens the union between the insert and the diaphragm. The insert also contains a circular orifice 88 that is spaced radially of sealing pad 84 and which is free of diaphragm material. The margins of insert 78 surrounding orifice 88 on opposite sides of the insert are also free of diaphragm material; however, just beyond the free margin on the side of the insert that faces the inside of cap 72, there is an annular zone 90 of diaphragm material of substantially uniform thickness. This zone is included within the larger circular zone 92 of uniform thickness diaphragm material on the side of insert 78 that faces the inside of cap 72. The inside of cap 72 contains three bosses 94 that are arranged in a circular pattern that is concentric with sealing pad 84. In the position represented by FIGS. 1 and 2, zone 92 is disposed against the flat end faces of bosses 94 with the included zone 90 disposed against the end face of one of the three bosses.

The condition portrayed by FIGS. 1 and 2 exists when the engine is not running because the gas pressures on opposite sides of movable wall 62 are equalized at essentially atmospheric pressure. Solenoid coil 36 is also not energized when the engine is not running, and so RCPS 24 permits no purging of canister 16.

When the engine is running, manifold vacuum exists and is communicated to chamber space 60 via passages 54 and 56. Chamber space 66 will be essentially at, or very close to, atmospheric pressure because of the path to atmosphere that exists through passage 68, conduit 20, and canister 16. Consequently, the gas pressure differential acting on movable wall 62 will displace the movable wall away from the position of FIGS. 1 and 2 and toward the end of passage 56. Once wall 62 has left abutment with bosses 94, flow occurs through orifice 88.

The size of orifice 88 is however such in relation to the ability of the engine to create and maintain manifold vacuum that the flow through movable wall 62 via orifice 88 has essentially no effect on the position that will be assumed by the movable wall in relation to the end of passage 56 for any intensity of manifold vacuum within the range of vacuums for which RCPS valve 24 is designed. The end of passage 56 forms a valve seat 96 disposed for cooperation with sealing pad 84. Sealing pad 84 constitutes a valve element that coacts with valve seat 96 to perform the regulation function for RCPS 24. The greater the magnitude of manifold vacuum, the greater the restriction on purge flow by the cooperative effect of sealing pad 84 and valve seat 96, and the lower the magnitude of manifold vacuum, the lesser the restriction. In this way the purge flow that is commanded by the computer control of solenoid 32 is made relatively insensitive to the magnitude of manifold vacuum over a certain range of vacuum. Solenoid 32 is typically pulse-width modulated by computer 34 to produce a restriction in the purge flow path that is correlated to the pulse-width modulated signals delivered to the solenoid coil. With the inclusion of the regulation function, changes in manifold vacuum do not substantially alter the response of RCPS valve 24 to the pulse-width modulated signals signals delivered to its solenoid coil 36. The purge flow path from inlet port 22 through RCPS 24 to outlet port 26 comprises: passage 50, passage 52, chamber 58, a hole 98 that continuously communicates chamber 58 with chamber space 64, chamber space 64, passage 56, and passage 54. Conduit 68, chamber space 66, and orifice 88 provide a parallel flow path that extends between inlet port 22 and chamber space 64 and in the process by-passes the solenoid-controlled valve which is formed in part by valve head 46 and valve seat 48.

The presence of orifice 88 in conjunction with the connection of chamber space 66 to atmosphere through canister 16 provides a certain degree of purging at engine idle where the manifold vacuum is high but the actual induction flow into the engine is relatively low. If orifice 88 were omitted and chamber space 66 were vented directly to atmosphere, as in U.S. Pat. No. 4,944,276, suitable purging at idle would be difficult to achieve. With the invention, idle purging is controlled by the predetermined pressure vs. flow characteristics of orifice 88 so that instead of a pulsating purging that would typically be expected to occur at engine idle by modulating solenoid 32, smooth regulated purging occurs at idle while solenoid 32 is de-energized and the purge flow is established precisely by the orifice size. A suitably sized orifice 88 will provide suitable idle purging without any significant influence on the controlled purging that is performed at other than engine idle when movable wall 62 is away from the position of FIGS. 1 and 2. When the engine is shut off, the equalization of gas pressure across movable wall 62 enables spring 80 to move zone 90 back into abutment with its boss 94 so that orifice 88 is closed to flow and there is no potential leak path through the regulator portion of RCPS valve 24 from canister 16 to intake manifold 28. Thus orifice 88, annular zone 90, and the boss 94 with which annular zone 90 abuts when the engine is off may collectively be considered to constitute an orifice valve means which is open when the engine is running and closed when the engine is off. Sealing this orifice when the engine is off is important as the tank can be at a slightly positive pressure and it is imperative that the pressurized vapor is released to atmosphere only via the canister.

A regulated purge valve and system embodying principles of the invention may be designed for a particular use through the practice of conventional engineering principles. Materials appropriate for the use should be employed. While the drawing shows the use of a nipple 100 in end cap 72 and a nipple 102 teed into passage 50 to provide for the connections of conduit 68, a valve could be designed which incorporates conduit 68 as an internal passage within the body structure.

FIG. 4 is a graph depicting a representative flow characteristic 108 for RCPS valve 24 as a function of engine operation and duty cycle of signals applied to solenoid 32. When the engine is off, any flow between ports 22 and 24 is prohibited. When the engine is on, the valve will operate along the representative flow characteristic 108. The horizontal segment of 108 between 0% and 10% duty cycle indicates the effect of the valve on accomplishing improved purging at engine idle.

While a presently preferred embodiment of the invention has been illustrated and described, it should be appreciated that principles are applicable to other embodiments falling within the scope of the following claims.

What is claimed is:

1. In a regulated canister purge solenoid valve for purging fuel vapor that has been collected in a collection canister to an intake manifold of an internal combustion engine so that the collected vapor can entrain with combustion flow into combustion chamber space of the engine, said valve having body structure including an inlet port for connection to such a canister, an outlet port for connection to such a manifold, and a flow path between said inlet port and said outlet port which is controlled by a solenoid-operated valve means in accordance with a received electrical control signal, said valve also having regulator means which has a movable wall that divides a chamber of said body structure into two chamber spaces on opposite sides of said wall, one of said chamber spaces forming a portion of said flow path that is disposed between said solenoid-operated valve means and said outlet port and has an entrance for vapor flow entering said one chamber space and an exit for vapor flow exiting said one chamber space, said regulator means further having regulator valve means that is controlled by said movable wall and is disposed at said exit from said one chamber space for rendering the vapor flow through said flow path substantially insensitive to the magnitude of intake manifold vacuum at said outlet port, and spring means that biases said movable wall toward a position that maximally opens said regulator valve means, the improvement which comprises:

passage means placing the other of said chamber spaces in communication with said inlet port, and orifice valve means providing selective communication between said one chamber space and said other chamber space in accordance with the position of said movable wall, said orifice valve means comprising orifice means between said one and said other chamber spaces which provides between said one and said other chamber spaces for all positions of said movable wall other than when said movable wall is in position that maximally opens said regulator valve means a particular pressure vs. flow characteristic in relation to flow of vapor through said flow path between said inlet port and said outlet port, said orifice valve means closing said orifice means when said movable wall is in position that maximally opens said regulator means.

2. The improvement set forth in claim 1 in which said orifice means is disposed in said movable wall.

3. The improvement set forth in claim 2 in which said movable wall comprises a diaphragm and an insert that is disposed centrally of said diaphragm and is of a material that is relatively more rigid than the material of said diaphragm, and said orifice means extends through said insert and is not covered by material of said diaphragm.

4. The improvement set forth in claim 3 in which said body structure contains a boss which is within said other chamber space and with which an annular zone of material of said diaphragm bounding said orifice means abuts to close said orifice means when said movable wall is in position that maximally opens said regulator means.

5. In a regulated canister purge solenoid valve for purging fuel vapor that has been collected in a collection canister to an intake manifold of an internal combustion engine so that the collected vapor can entrain with combustion flow into combustion chamber space of the engine, said valve having body structure including an inlet port for connection to such a canister, an outlet port for connection to such a manifold, and a flow path between said inlet port and said outlet port which is controlled by a solenoid-operated valve means in accordance with a received electrical control signal, said valve also having regulator means which has a movable wall that divides a chamber of said body structure into two chamber spaces on opposite sides of said wall, one of said chamber spaces forming a portion of said flow path that is disposed between said solenoid-operated valve means and said outlet port and has an entrance for vapor flow entering said one chamber space and an exit for vapor flow exiting said one chamber space, said regulator means further having regulator valve means that is controlled by said movable wall and is disposed at said exit from said one chamber space for rendering the vapor flow through said flow path substantially insensitive to the magnitude of intake manifold vacuum at said outlet port and for causing said regulator valve means to be open when intake manifold vacuum does not exist, the improvement which comprises:

orifice means having a particular presure vs. flow characteristic in relation to flow of vapor through said flow path between said inlet port and said outlet port and disposed in flow conducting relationship between said inlet port and said regulator valve means so as to be in parallel flow relationship to said solenoid-operated valve means, and means to open said orifice means to flow when intake manifold vacuum exists and to close said orifice means to flow when intake manifold vacuum does not exist.

6. The improvement set forth in claim 5 in which said orifice means is disposed in said movable wall.

7. The improvement set forth in claim 6 in which said movable wall comprises a diaphragm and an insert that is disposed centrally of said diaphragm and is of a material that is relatively more rigid than the material of said diaphragm, and said orifice means extends through said insert and is not covered by material of said diaphragm.

8. The improvement set forth in claim 7 in which said means to open said orifice means to flow when intake manifold vacuum exists and to close said orifice means to flow when intake manifold vacuum does not exist comprises an abutment which is disposed within said other chamber space and with which an annular zone of material of said diaphragm bounding said orifice means abuts to close said orifice means when intake manifold vacuum does not exist.

9. In a regulated canister purge solenoid valve for purging fuel vapor that has been collected in a collection canister to an intake manifold of an internal combustion engine so that the collected vapor can entrain with combustion flow into combustion chamber space of the engine, said valve having body structure including an inlet port for connection to such a canister, an outlet port for connection to such a manifold, and a flow path between said inlet port and said outlet port which is controlled by a solenoid-operated valve means in accordance with a received electrical control signal, said valve also having regulator means which has a movable wall that divides a chamber of said body structure into two chamber spaces on opposite sides of said wall, one of said chamber spaces forming a portion of said flow path that is disposed between said solenoid-operated valve means and said outlet port, a valve element on said movable wall disposed within said one chamber space for coaction with a valve seat that circumscribes a passage leading to said outlet port to selectively restrict the flow between said one chamber space and said outlet port in accordance with the selective positioning of said movable wall within said one chamber space and thereby regulate against changes in magnitude of manifold vacuum at said outlet port, spring means disposed in said one chamber space for resiliently biasing said movable wall away from said valve seat, the improvement which comprises:

means defining an orifice through said movable wall to communicate said two chamber spaces, said orifice having a particular pressure vs. flow characteristic in relation to flow of vapor through said flow path between said inlet port and said outlet port, means for the exclusive ingress and egress of flow into and from the other of said chamber spaces comprising passage means establishing communication between said inlet port and said other chamber space, and an abutment which is disposed within said other chamber space to be abutted by said movable wall and close said orifice when said movable wall disposes said valve element most distant from said valve seat.

10. In an evaporative emission control system of an automotive vehicle powered by an internal combustion engine wherein fuel vapor from a fuel tank is collected in a canister which is purged to an intake manifold of the engine under conditions favorable to entrainment of the vapor with combustible mixture entering combustion chamber space of the engine, said emission control system comprising a regulated canister purge solenoid valve that is under the control of electric signals supplied to the valve from a computer that is associated with the operation of the engine, said valve having an inlet that is communicated to said canister, an outlet that is communicated to said manifold, and a flow path between said inlet and said outlet that includes a solenoid-controlled valve means and a regulator valve means, said regulator valve means comprising means to render the flow that is allowed by said solenoid-controlled valve means relatively insensitive to variations in the intensity of intake manifold vacuum at said outlet over a certain range of vacuums, the improvement for providing, particularly at relatively high manifold vacuum and relatively low induction flow in the intake manifold, a certain vapor purging flow which is along a flow path that is in parallel with said solenoid-controlled valve means and comprises:

an orifice means having a particular presure vs. flow characteristic in relation to flow of vapor through said first-mentioned flow path between said inlet and said outlet and disposed in flow conducting relationship between said inlet and said regulator valve means so as to be in parallel flow relationship to said solenoid-controlled valve means, and means to open said orifice means to flow when intake manifold vacuum exists and to close said orifice means to flow when intake manifold vacuum does not exist.

* * * * *